US010006244B2

(12) United States Patent
Balay et al.

(10) Patent No.: US 10,006,244 B2
(45) Date of Patent: Jun. 26, 2018

(54) OVERHEAD DOOR WITH LINTEL SEAL INTERFACE ASSEMBLY

(71) Applicant: CIW Enterprises, Inc., Mountaintop, PA (US)

(72) Inventors: Joseph L. Balay, Sugarloaf, PA (US); Joseph L. Kondash, Wilkes-Barre, PA (US)

(73) Assignee: CIW Enterprises, Inc., Mountaintop, PA (US)

( * ) Notice: Subject to any disclaimer, the term of this patent is extended or adjusted under 35 U.S.C. 154(b) by 0 days. days.

(21) Appl. No.: 15/041,531

(22) Filed: Feb. 11, 2016

(65) Prior Publication Data

US 2016/0177623 A1 Jun. 23, 2016

Related U.S. Application Data

(62) Division of application No. 14/312,206, filed on Jun. 23, 2014, now Pat. No. 9,279,287.

(60) Provisional application No. 61/839,987, filed on Jun. 27, 2013.

(51) Int. Cl.

| | |
|---|---|
| ***E06B 7/18*** | (2006.01) |
| ***E06B 9/17*** | (2006.01) |
| ***E06B 9/58*** | (2006.01) |

(52) U.S. Cl.

CPC ..... *E06B 9/17076* (2013.01); *E06B 9/58* (2013.01); *E06B 2009/588* (2013.01)

(58) Field of Classification Search

CPC .. E06B 9/17076; E06B 9/58; E06B 2009/588; E06B 7/18; E06B 7/205

USPC ..... 160/40, 41, 133

See application file for complete search history.

(56) References Cited

U.S. PATENT DOCUMENTS

| | | | | | |
|---|---|---|---|---|---|
| 68,150 | A | | 8/1867 | Baker | |
| 428,402 | A | | 5/1890 | Morris | |
| 625,678 | A | | 5/1899 | Hilzheim | |
| 1,554,161 | A | | 9/1925 | Hubbard | |
| 1,651,570 | A | * | 12/1927 | Woodcock | E06B 7/20 49/310 |
| 1,779,215 | A | * | 10/1930 | Larson | E06B 7/232 49/304 |
| 2,321,730 | A | * | 6/1943 | Benson | E06B 7/20 49/314 |
| 2,663,056 | A | * | 12/1953 | Hardgrave | E06B 7/205 49/305 |
| 2,694,234 | A | * | 11/1954 | Roby | E06B 7/367 16/250 |
| 2,813,315 | A | * | 11/1957 | Menzies | E06B 7/20 49/312 |

(Continued)

FOREIGN PATENT DOCUMENTS

| | | |
|---|---|---|
| EP | 0797722 | 6/1996 |
| EP | 1935281 | 6/2008 |

(Continued)

*Primary Examiner* — Katherine W Mitchell
*Assistant Examiner* — Johnnie A. Shablack
(74) *Attorney, Agent, or Firm* — Mitchell A. Smolow

(57) ABSTRACT

An overhead door guide cover that includes a first leg and a second leg separated by an inter-hinge area. A first end of the inter-hinge area is joined with the first leg at a first hinge. A second end of the inter-hinge area is joined with the second leg of a second hinge. The second leg is for engaging a door guide assembly; and the first leg is for engaging a structure wall.

12 Claims, 5 Drawing Sheets

(56) References Cited

U.S. PATENT DOCUMENTS 2,922,474 A * 1/1960 Smith ..... E05D 15/262 160/183
3,027,937 A * 4/1962 Wilson ..... E06B 7/18 160/40
3,198,242 A * 8/1965 Downs ..... E05D 15/165 160/190
3,334,681 A * 8/1967 Crosswell ..... E05D 15/165 16/86 A
3,339,619 A 9/1967 Crosswell
3,489,200 A 1/1970 Recchione
3,757,845 A 9/1973 Pagliaro
4,467,853 A 8/1984 Downey, Jr.
4,690,195 A * 9/1987 Taylor ..... E06B 9/70 160/133
4,957,301 A 9/1990 Clay, Jr.
5,201,530 A 4/1993 Kelch
5,419,084 A 5/1995 Sankey
5,445,209 A 8/1995 Lichy
5,480,165 A 1/1996 Flower
5,482,104 A 1/1996 Lichy
5,544,690 A 4/1996 Magro et al.
5,657,805 A 8/1997 Magro
5,718,276 A * 2/1998 Rekret ..... E05D 15/242 160/201
5,794,678 A * 8/1998 Beringer ..... E06B 9/42 160/268.1
6,129,130 A * 10/2000 Rekret ..... E05D 15/242 160/40
6,141,909 A * 11/2000 Hanson ..... E06B 7/367 16/250
6,260,601 B1 * 7/2001 Thomas ..... E05D 15/165 160/133
6,357,507 B1 3/2002 Stoebich et al.
6,374,567 B1 4/2002 Mullet
6,497,073 B2 12/2002 Webb
6,840,300 B2 * 1/2005 Lewis, Jr. ..... E05D 15/0621 160/201
6,931,789 B2 * 8/2005 Stout, Jr. ..... E06B 7/367 160/40
7,055,571 B2 * 6/2006 Johnston ..... E05D 15/24 160/201
7,089,990 B2 * 8/2006 Hormann ..... E05D 15/165 160/201
7,117,916 B2 * 10/2006 Johnston ..... E05D 15/24 160/201
7,131,481 B2 * 11/2006 Varley ..... E06B 9/13 160/133
7,182,119 B2 2/2007 Woodward et al.
7,516,770 B2 * 4/2009 Jerry ..... E06B 9/13 160/267.1
7,784,520 B2 8/2010 Paulson
7,836,635 B2 * 11/2010 Webb ..... E06B 7/367 49/384
8,113,265 B2 2/2012 Hardison, III et al.
8,146,985 B2 4/2012 Nelson
8,291,960 B2 * 10/2012 Bowman ..... E06B 9/13 160/267.1
8,505,923 B2 8/2013 Ferryman et al.
8,893,764 B2 * 11/2014 Mascari ..... E05D 15/165 16/82
8,910,421 B2 12/2014 Potter
9,032,668 B2 * 5/2015 Blackwood ..... E06B 7/2305 49/475.1
9,068,655 B2 6/2015 Ferryman et al.
9,279,287 B2 * 3/2016 Balay ..... E06B 9/58
9,458,665 B2 * 10/2016 Drifka ..... E06B 9/581
9,512,669 B2 * 12/2016 Sentjurc ..... E06B 9/17076
2004/0163326 A1 * 8/2004 Miller ..... B65G 69/008 52/2.12
2005/0133170 A1 * 6/2005 Hormann ..... E05D 15/165 160/201
2005/0252619 A1 * 11/2005 Coenraets ..... E06B 9/54 160/89
2007/0131358 A1 * 6/2007 Iwasaki ..... E06B 9/58 160/133
2008/0309017 A1 12/2008 Mattice
2010/0218426 A1 * 9/2010 Johnson ..... E06B 7/367 49/383
2011/0227289 A1 9/2011 Stefan
2013/0098566 A1 4/2013 Horvath
2013/0220559 A1 8/2013 Dwarka
2013/0263516 A1 10/2013 Potter
2013/0277918 A1 10/2013 Fritgerald et al.
2013/0306252 A1 11/2013 Lambridis et al.
2015/0361703 A1 * 12/2015 McDonald ..... E06B 3/44 160/113
2017/0152705 A1 * 6/2017 Frede ..... E06B 9/17076

FOREIGN PATENT DOCUMENTS

EP 2017509 1/2009
GB 2299363 A * 10/1996 ..... E06B 9/15

* cited by examiner

OVERHEAD DOOR WITH LINTEL SEAL INTERFACE ASSEMBLY

CROSS REFERENCE TO RELATED APPLICATIONS

This application is a division of and claims benefit of U.S. application Ser. No. 14/312,206 filed Jun. 26, 2014 which claims benefit of U.S. Provisional Application No. 61/839,987 filed Jun. 27, 2013.

FIELD OF THE INVENTION

This invention relates generally to overhead doors and in particular, to an overhead door with a lintel seal.

BACKGROUND OF THE INVENTION

Rolling Steel Doors are metal slatted overhead coiling doors that roll up to store in coil above the opening. They are used to provide security against entry or to provide weather protection at exterior and interior openings in industrial, commercial, institutional and other buildings. They are also called overhead coiling doors or service doors.

Although they are sometimes considered to be interchangeable there are dramatic differences between Rolling Steel and Sectional Doors. Some of these differences are based on material, with Rolling Steel doors generally having heavier duty, sustainable construction. Also, Rolling Steel Doors have mounting advantages that make them uniquely suitable for specific applications.

Rolling Steel Doors have many fewer parts than sectional doors with less risk for damage and inoperability making them a better solution for facilities that cannot afford opening downtime. Sectional garage doors have 30 to 40 moving parts that are all exposed and subject to dirt, debris and damage. Any of these parts if faulty or damaged will cause the door to become completely inoperable and/or pose a serious life safety risk.

Rolling steel doors have a heavy duty steel curtain that coils upon a counterbalance shaft. Their heavy duty springs are protected and sealed inside the counterbalance shaft and heavily coated with grease to eliminate the possibility of rust or freezing.

Coiling doors are mounted to the face of the wall and supported by vertical guide assemblies. They require no connection to the ceiling or roof structure. Sectional garage doors are typically mounted to the vertical face of the wall, but a horizontal track must be supported from the ceiling or roof structure.

With any door design, if there is passage of air or water between the door and the structure, damage to the structure interior and its contents may result. Heating and cooling costs may also be adversely affected. To prevent these problems various barriers have been designed. One such design sandwiches a relatively rigid sheet between two rows of bristles, all of equal length. However, this design of equal length bristles has proven to be less than effective.

Accordingly, there is still a continuing need for improved designs to eliminate the overhead door lintel and guide assembly—building structure gap. The present invention fulfills this need and further provides related advantages.

BRIEF SUMMARY OF THE INVENTION

The overhead door using a lintel seal interface assembly described below is a novel design to help reduce or prevent outside air, wind, rain, or snow from passing through the door—structure interface without adversely affecting door operation.

In a preferred embodiment an overhead coiling door includes a lintel seal interface assembly comprising a mounting bracket and a seal material sandwiched between a top and bottom row of brush bristles, the top row of bristles being shorter than the bottom row. This interface assembly geometry provides relative rigidity to the flexible seal material and maintains greater cycle life.

Further described are novel insulating material placement used to seal the building structure—door gaps. In one preferred design, a hinged guide cover has a first leg geometry to engage the structure and a second leg geometry to engage the guide assembly to effectively seal gaps created by various amounts of guide assembly setback.

The hinged guide cover offers some distinct advantages, for example, it acts as a trim piece to close off the guide assemblies from the exterior using fasteners for positive attachment to the guide assemblies and the wall; it thermally breaks the guide assemblies from the outside temperature to reduce temperature transfer into the building preventing the guide assemblies from sweating/frosting depending on the outside temperature; it provides the ability to have a slide in seal for the guide assemblies; and it is more robust than solely applying foam, making inadvertent loss of insulation less likely.

Other features and advantages of the present invention will be apparent from the following more detailed description of the preferred embodiments, taken in conjunction with the accompanying drawings which illustrate, by way of example, the principles of the invention.

BRIEF DESCRIPTION OF THE DRAWINGS

The accompanying drawings are included to provide a further understanding of the present invention. These drawings are incorporated in and constitute a part of this specification, illustrate one or more embodiments of the present invention, and together with the description, serve to explain the principles of the present invention.

Figure 1:
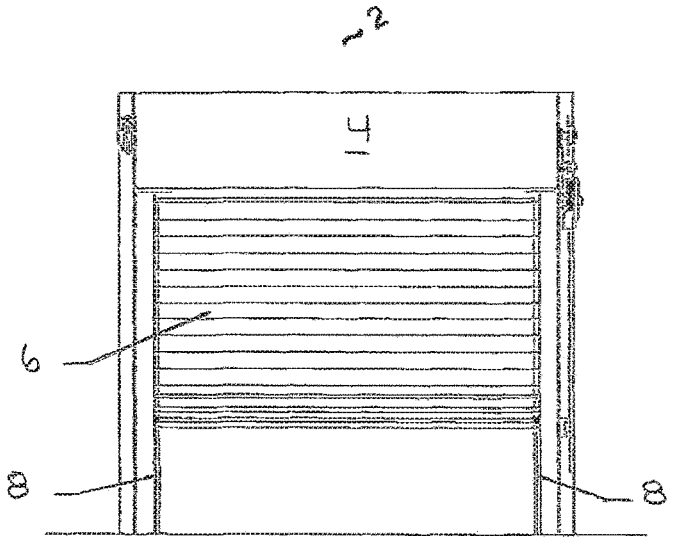
FIG. 1 is a front view of an overhead coiling rolling steel door.

Other features and advantages of the present invention will be apparent from the following more detailed description of the preferred embodiments, taken in conjunction with the accompanying drawings which illustrate, by way of example, the principles of the invention.

DETAILED DESCRIPTION OF THE INVENTION

As required, detailed embodiments of the present invention are disclosed; however, it is to be understood that the disclosed embodiments are merely exemplary of the invention that may be embodied in various forms. The figures are not necessary to scale, and some features may be exaggerated to show details of particular components. Therefore, specific structural and functional details disclosed are not to be interpreted as limiting, but merely as a basis for the claims and as a representative basis for teaching one skilled in the art to variously employ the present invention. Where possible, like reference numerals have been used to refer to like parts in the several alternative embodiments of the present invention described herein.

For purposes of this disclosure the term "operator" is meant to comprise both motorized and non-motorized assemblies that provide turning force to the counterbalance shaft.

Figure 2:
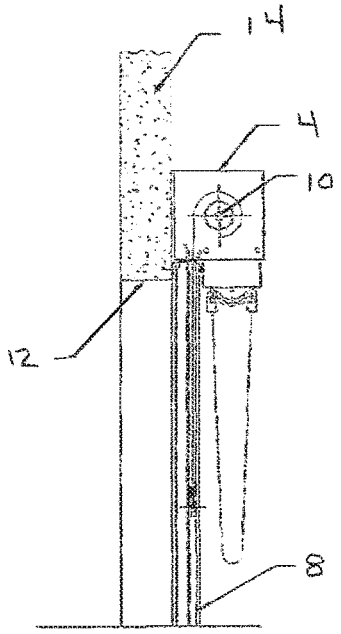
FIG. 2 is a side view of the overhead coiling rolling steel door of FIG. 1.

Turning now to the figures, FIGS. 1 and 2 depict an overhead door, for example, and overhead coiling rolling steel door 2 comprising an operator 4, a coiling curtain 6, for example operatively connected metal slats, and curtain retaining guide assemblies 8. The coiling curtain 6 travels and is maintained within guide assemblies 8 as the curtain is wound and unwound around an operator driven counterbalance shaft 10. The guide assemblies 8 have curved portions 54 at their top end to form a bell mouth. (See FIGS. 4, 6, and 10*a*-10*c*).

A lintel seal interface assembly 12 is mounted to the door lintel 14. For purposes of this specification, the term lintel refers to a horizontal structural member over an opening which carries the weight of the wall above it. The components of the lintel seal interface assembly 12 comprise a bracket 16 and a brush assembly 18 (FIGS. 4 and 6).

Figure 3:
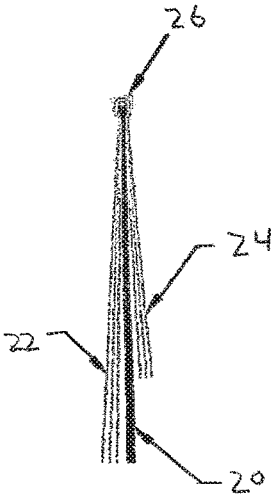
FIG. 3 is a side view of a lintel seal interface brush assembly.

Depicted in FIG. 3, the brush assembly 18 comprises a seal material 20, preferably a flexible seal material, for example an ethylene propylene diene monomer ("EPDM") sheet, sandwiched between a longer bottom set of bristles 22 and a shorter top set of bristles 24. A key 26 is formed opposite the bristle end. The shorter top set of bristles 24 are preferably about 1.25 inches to about 0.5 inches shorter than the longer bottom set of bristles 22, and most preferably, about 0.75 inches shorter.

When the door is closed, the shorter top set of bristles 24 allow the EPDM sheet to contact and conform to any irregularity in the door curtain 6 to provide a more effective seal than that provided by top and bottom bristles of equal length. It was found that top bristles and bottom bristles of equal length interfered with the seal material contacting the curtain. Top and bottom bristles of the same length prevented the EPDM sheet from effectively sealing to the curtain. The sealing failure prevented a door from meeting the Air Infiltration Standard (IECC 2012) of 1.0 cfm/sq ft., incorporated by reference. When a lintel seal interface assembly 12 comprising the novel design of a shorter top set of bristles was incorporated into the door the requirements of Air Infiltration Standard (IECC 2012) were unexpectedly met.

Figure 4:
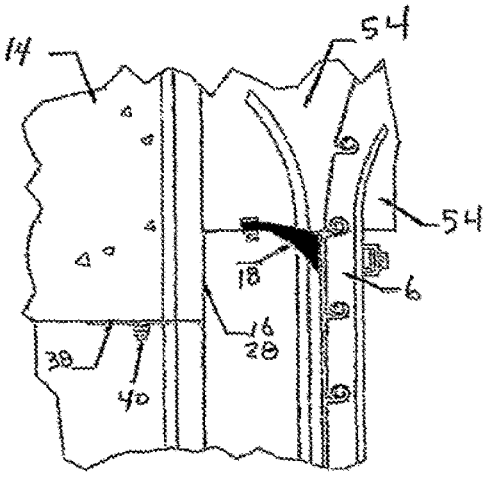
FIG. 4 is a side view of an installed lintel seal interface assembly using a Z bracket.
Figure 5:
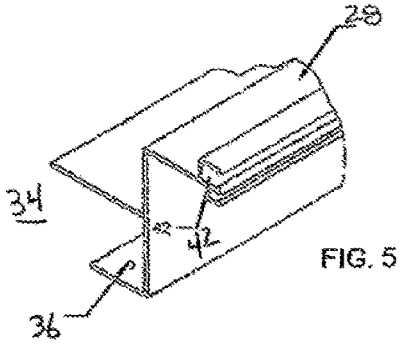
FIG. 5 is a perspective view of the Z bracket of FIG. 4.
Figure 6:
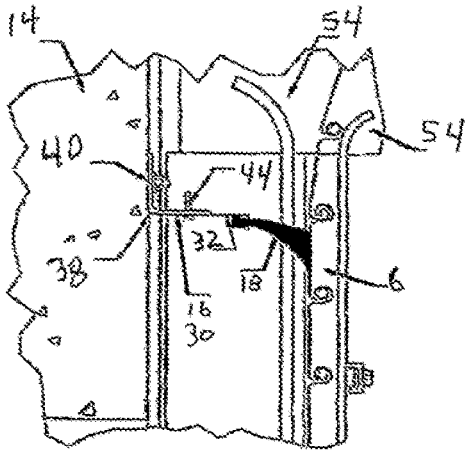
FIG. 6 is a side view of an installed lintel seal interface assembly using an L bracket.
Figure 7:
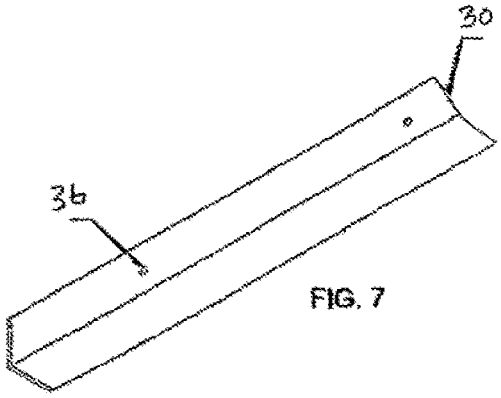
FIG. 7 is a perspective view of the L bracket of FIG. 6.
Figure 8A:
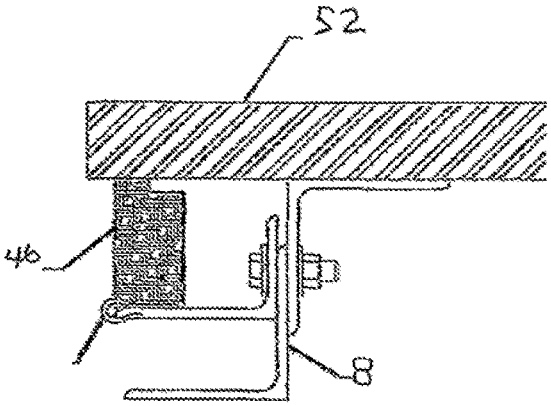
FIGS. 8*a*-8*h* are top views of a guide assembly with sealing materials.
Figure 8B:
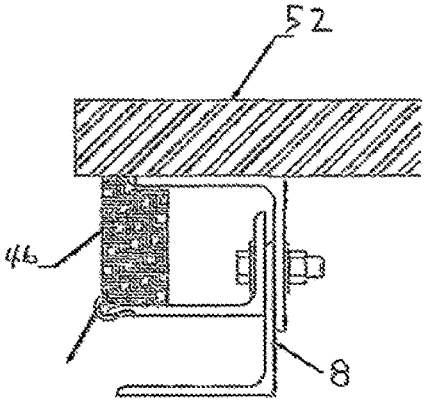
Figure 8C:
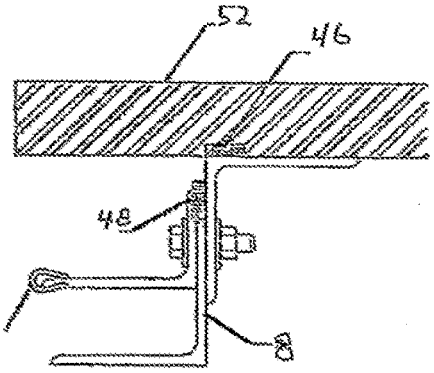
Figure 8D:
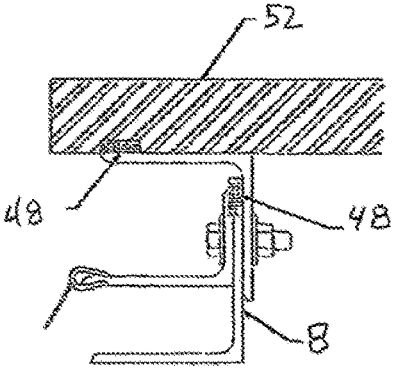
Figure 8E:
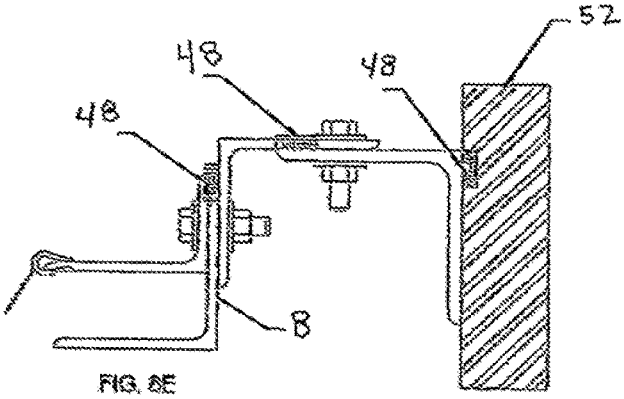
Figure 8F:
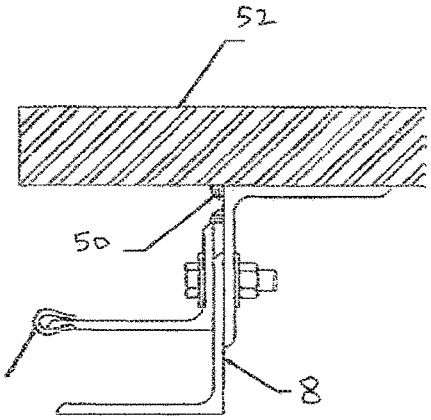
Figure 8G:
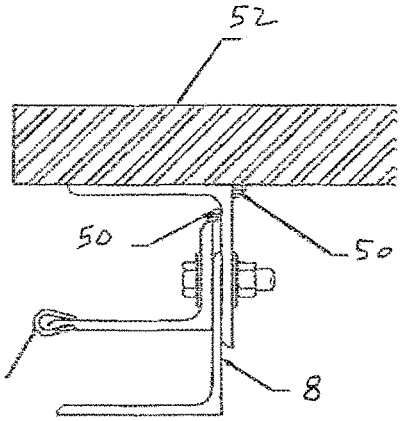
Figure 8H:
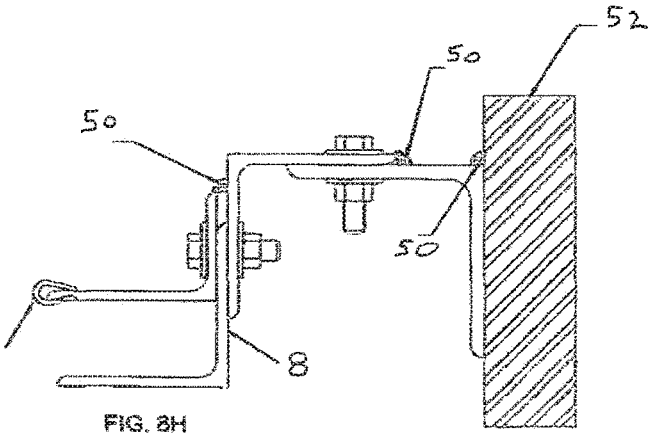

Turning now to FIGS. 4-7, two preferred bracket designs are depicted. FIGS. 4 and 5 depict a Z shaped bracket 28 while FIGS. 6 and 7 depict a L shaped bracket 30 optionally used in combination with mounting angle 32 (FIG. 6) to aid in positioning the brush assembly 18.

In installing the Z shaped bracket 28 field cuts as needed are made to the bracket 28 to produce cutout area 34 to allow for the guide assembly setback and pack-off. With either bracket design, 28, 30 mounting holes 36 are utilized to mount the bracket 28, 30 to the header/lintel 14 with a fastener 40, for example a screw or bolt. Preferably the mounting holes 36 are spaced a maximum of about 24 inches apart. With Z bracket 28 the mounting holes 36 are preferably positioned about equally between the front edge of the header/lintel 14 and the back edge of the bracket 28. With L bracket 30 the mounting holes 36 are preferably positioned about equally between the front and the back edges of the bracket 30. Mounting angle 32 is fixed to L bracket 30 with fastener 44.

The brush assembly 18 is fixed to the bracket 28 or mounting angle 32, for example by inserting brush assembly key 26 into keyway 42. As shown in FIG. 5 there may be more than one keyway 42 to aid in effective brush assembly 18 placement.

The brush assembly 18 is mounted and positioned such that the seal material 20 contacts the closed curtain 6 with the bristles 22, 24 pushed to a predetermined angle, for example about a 55 degree to about a 35 degree angle, preferably about a 45 degree angle. The shorter top set of bristles 24 are faced upward towards the operator counterbalance shaft 10. A sealant 38, for example silicone, may be applied.

In addition to the novel brush configuration, optionally, sealing materials, for example, foam block 46, pressure sensitive seal tape 48, and/or caulking 50 may be placed between the guide assembly 8 and the structure wall 52 to further reduce or prevent air and/or water infiltration as depicted in FIGS. 8*a*-8*h*. The sealing materials also add to the insulation value of the door, thereby achieving a better u-factor than merely adding a higher insulated curtain as is the current practice.

Figure 9:
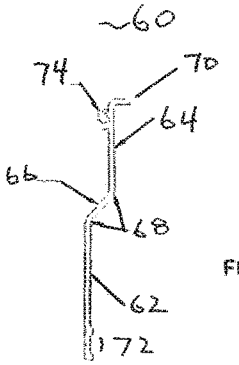
FIG. 9 is a top view of an insulating guide cover.
Figure 10A:
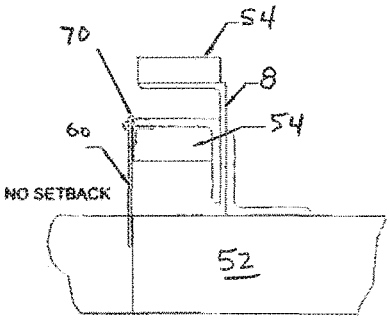
FIGS. 10*a*-10*c* are bottom views of an installed guide seal cover.
Figure 10B:
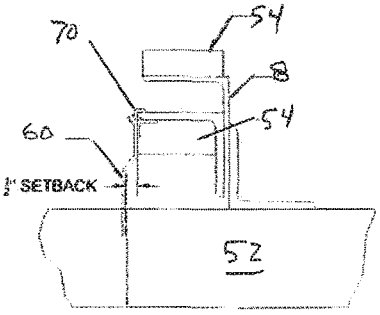
Figure 10C:
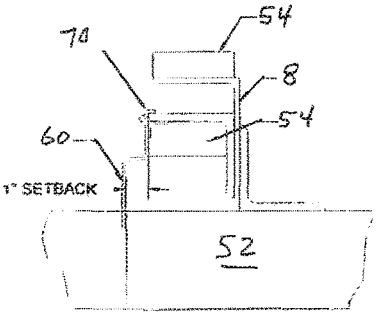

During door installation it is not uncommon that the guide assemblies 8 are set back from the structure opening as depicted in FIGS. 10*a*-10*c*, providing additional avenues for air or water ingress. Turning to FIG. 9, guide cover 60 comprises a first leg 62 and a second leg 64 separated by an inter-hinge area 66 defined by hinges 68 at the inter-hinge area—first leg interface and the inter-hinge area—second leg interface. The second leg 64 comprises a guide assembly engaging geometry 70 and the first leg 62 comprises a structure wall engaging geometry 72. Optional groove 74 receives an optional slide-in weather seal.

Once in place as depicted in FIGS. 10*a*-10*c*, guide cover 60 prevents air or water ingress resulting from the guide assembly setback. Preferably the inter-hinge area 66 is about 1 inch to about 1.75 inches and most preferably about 1⅛ inches in length which allows for effective isolation or sealing of the most common guide assembly setback gaps encountered in the field.

Although the present invention has been described in connection with specific examples and embodiments, those skilled in the art will recognize that the present invention is capable of other variations and modifications within its scope. These examples and embodiments are intended as typical of, rather than in any way limiting on, the scope of the present invention as presented in the appended claims.

What is claimed is:

1. An overhead door guide cover comprising a first leg and a second leg separated by an inter-hinge area; a first end of the inter-hinge area joined with the first leg at a first hinge; a second end of the inter-hinge area joined with the second leg of a second hinge; the second leg comprising a door guide assembly engaging geometry; and the first leg comprising a structure wall engaging geometry; wherein the first leg and the second leg are about parallel to one another.

2. The overhead door guide cover of claim 1 wherein the inter-hinge area is about 1 inch to about 1.75 inches in length.

3. The overhead door guide cover of claim 1 wherein the guide cover further comprises a groove for receiving a slide-in seal.

4. The overhead door guide cover of claim 1 wherein the inter-hinge area is about 1 inch to about 1.75 inches in length and wherein the guide cover further comprises a groove for receiving a slide-in seal.

5. An overhead door comprising:

an operator operatively connected to a counterbalance shaft;

a coiling curtain retained within a first and second curtain retaining guide assembly, windingly and unwindingly attached to the counterbalance shaft; and an overhead door guide cover comprising a first leg and a second leg separated by an inter-hinge area; a first end of the inter-hinge area joined with the first leg at a first hinge; a second end of the inter-hinge area joined with the second leg of a second hinge; the second leg comprising a guide assembly engaging geometry; and the first leg comprising a structure wall engaging geometry;

wherein the first leg and the second leg are about parallel to one another.

6. The overhead door of claim 5 wherein the inter-hinge area is about 1 inch to about 1.75 inches in length.

7. The overhead door of claim 5 wherein the guide cover further comprises a groove for receiving a slide-in seal.

8. The overhead door of claim 5 wherein the inter-hinge area is about 1 inch to about 1.75 inches in length and wherein the guide cover further comprises a groove for receiving a slide-in seal.

9. A method of installing a guide cover to an overhead coiling door comprising the steps of:

engaging a guide cover second leg to a door guide assembly; and engaging a guide cover first leg to a structure wall; wherein the guide cover comprises an inter-hinge area separating the first leg and the second leg; a first end of the inter-hinge area joined with the first leg at a first hinge; a second end of the inter-hinge area joined with the second leg of a second hinge, the second leg comprising a guide assembly engaging geometry; and the first leg comprising a structure wall engaging geometry; wherein the first leg and the second leg are about parallel to one another.

10. The method of claim 9 wherein the inter-hinge area is about 1 inch to about 1.75 inches in length.

11. The method of claim 9 wherein the guide cover further comprises a groove for receiving a slide-in seal.

12. The method of claim 9 wherein the inter-hinge area is about 1 inch to about 1.75 inches in length and wherein the guide cover further comprises a groove for receiving a slide-in seal.

* * * * *